US008864547B2

(12) United States Patent
Elson et al.

(10) Patent No.: US 8,864,547 B2
(45) Date of Patent: Oct. 21, 2014

(54) REPOSITIONABLE TOY-ATTACHMENT DEVICE

(75) Inventors: Brittany Elson, Atlanta, GA (US); Bradford Reese, Decatur, GA (US)

(73) Assignee: Kids II, Inc., Atlanta, GA (US)

( * ) Notice: Subject to any disclaimer, the term of this patent is extended or adjusted under 35 U.S.C. 154(b) by 116 days.

(21) Appl. No.: 13/610,201

(22) Filed: Sep. 11, 2012

(65) Prior Publication Data

US 2013/0065480 A1 Mar. 14, 2013

Related U.S. Application Data

(60) Provisional application No. 61/534,087, filed on Sep. 13, 2011.

(51) Int. Cl.
*A63H 33/00* (2006.01)

(52) U.S. Cl.
CPC ..... *A63H 33/006* (2013.01); *A63H 33/008* (2013.01)
USPC ..... 446/227

(58) Field of Classification Search
CPC ... A63H 33/006; A47F 5/0807; A47F 5/0838; A47F 5/0846
USPC ..... 446/227; 248/317, 323
See application file for complete search history.

(56) References Cited

U.S. PATENT DOCUMENTS

| | | | | |
|---|---|---|---|---|
| 2,762,161 | A * | 9/1956 | Danielson | 446/227 |
| 3,978,610 | A * | 9/1976 | Stubbmann | 446/227 |
| 4,664,640 | A * | 5/1987 | Shindo et al. | 446/227 |
| 4,826,022 | A * | 5/1989 | Duarte | 211/59.1 |
| 5,913,771 | A * | 6/1999 | Nail | 5/53.1 |
| 5,928,054 | A * | 7/1999 | Mast | 446/227 |
| 6,099,377 | A * | 8/2000 | Pridemore | 446/227 |
| 6,149,489 | A * | 11/2000 | Johnson | 446/227 |
| 6,732,984 | B2 * | 5/2004 | Tsai | 248/125.1 |
| 6,742,749 | B2 * | 6/2004 | Kassai et al. | 248/163.2 |
| 6,772,890 | B2 * | 8/2004 | Campbell et al. | 211/94.01 |
| 8,070,552 | B2 * | 12/2011 | Snyder | 446/227 |
| 8,376,308 | B2 * | 2/2013 | Greve' | 248/496 |
| 8,460,053 | B2 * | 6/2013 | Fair et al. | 446/227 |
| 2002/0077020 | A1 * | 6/2002 | Graf et al. | 446/227 |
| 2004/0242118 | A1 * | 12/2004 | Schreiber-Setzemski et al. | 446/227 |
| 2004/0266312 | A1 * | 12/2004 | Oren et al. | 446/227 |
| 2007/0080126 | A1 * | 4/2007 | Music | 211/184 |
| 2009/0253342 | A1 * | 10/2009 | Oren et al. | 446/227 |
| 2011/0076912 | A1 * | 3/2011 | Snyder | 446/227 |

* cited by examiner

*Primary Examiner* — Kurt Fernstrom
(74) *Attorney, Agent, or Firm* — Gardner Groff Greenwald & Villanueva, PC

(57) ABSTRACT

An attachment mechanism for suspending one or more toys or other objects from a child-support apparatus such as a crib, bassinet, car seat, stroller, swing, bouncer, play gym, play yard, jumper, or the like. Typically, the child-support apparatus includes one or more beams or other supports where the toy-attachment mechanism is located. The toy-attachment mechanism includes a repositioning track and a slide coupling that is repositionable along the track and from which toys can be suspended. In typical embodiments, the track and the coupling include mating teeth that interlock to hold the coupling in place but that can be disengaged to reposition the coupling and the toys suspended therefrom.

18 Claims, 10 Drawing Sheets

REPOSITIONABLE TOY-ATTACHMENT DEVICE

CROSS-REFERENCE TO RELATED APPLICATION

This application claims the priority benefit of U.S. Provisional Patent Application Ser. No. 61/534,087 filed Sep. 13, 2011, the entirety of which is hereby incorporated herein by reference for all purposes.

TECHNICAL FIELD

The present invention relates generally to the field of apparatus for supporting and/or amusing children, and more particularly to such apparatus with toys attached thereto.

BACKGROUND

Conventional apparatus for holding and amusing children include cribs, bassinets, car seats, strollers, swings, mobiles, bouncers, play gyms, play yards, jumpers, etc. Such child-support apparatus sometimes include attachments for toys for the amusement of the child in the apparatus. Typically, the child-support apparatus includes one or more support beams extending upwards and laterally over the child in the apparatus, with the attachments positioned on the beams and with the toys suspended from the attachments. Some toys are larger than others and thus can be suspended from only certain ones of the attachments. This is because in known child-support apparatus the attachments are in fixed positions on the beams. So if the attachments are positioned too low or too close together, then some longer or wider toys cannot be hung from them with good effect.

Accordingly, it can be seen that needs exist for better ways to provide for suspending toys from child-support apparatus. It is to the provision of solutions meeting these and other needs that the present invention is primarily directed.

SUMMARY

The present invention relates to a repositionable attachment mechanism for suspending or otherwise attaching a toy or other object from or on a support of a child-support apparatus. The attachment mechanism includes a repositioning track formed along the support and a slide coupling that is repositionable along the track and from which the toy can be suspended. In typical embodiments, the support is a beam and the child-support apparatus is a crib, bassinet, car seat, stroller, swing, mobile, bouncer, play gym, play yard, jumper, or the like.

In an example embodiment, the track includes a series of teeth and the coupling includes at least one tooth that mates with the track teeth. In this way, the track and coupling teeth interlock to hold the coupling in place, but can be disengaged to reposition the coupling and the objects attached thereto.

Typically, the track teeth extend upward/outward and, when the repositionable coupling is engaged with the track, the coupling tooth extends downward/inward. In this way, because of the combined weight of the coupling and the toy, the force of gravity moves the coupling tooth downward into interlocking engagement with the track teeth to retain the coupling in a locked position. In addition, the coupling can be moved inward/upward to an unlocked position in which the track and coupling tooth or teeth are disengaged, the disengaged coupling can be slid along the track and repositioned, and the coupling can be released so that the force of gravity moves the coupling back into the locked/engaged position. The track can be formed along an inner/lower surface of the support having a lateral aspect so that the effect of gravity can be best realized to interlock the track and coupling tooth or teeth together and thereby retain the coupling in the locked position. Thus, by repositioning the coupling, the toy can be positioned along the span of the track wherever desired. In alternate embodiments of the invention, a spring coupling, magnet or other biasing means bias the coupling toward the locked/engaged position on the track, and the attachment mechanism can be positioned in any orientation, without reliance on gravity to engage the coupling in position on the track.

In one aspect, the invention includes the child-support apparatus and the repositionable toy-attachment mechanism. In other aspect, the invention includes the repositionable toy-attachment mechanism but not the child-support apparatus, with the repositionable toy-attachment mechanism provided as a separate component that can be mounted to the child-support apparatus. In yet another aspect, the invention includes the repositionable toy-attachment mechanism and the support, but not the rest of the child-support apparatus. And in yet another aspect, the invention includes the repositionable toy-attachment mechanism and the child-support apparatus with the toys permanently attached to the attachment mechanism.

In another aspect, the invention relates to an attachment mechanism for repositionably attaching an object to a child-support apparatus. The attachment mechanism preferably includes a repositioning track formed along the child-support apparatus, and a slide coupling that is repositionable along the track and to which the object can be attached.

In still another aspect, the invention relates to a repositionable attachment mechanism for suspending a toy from a support of a child-support apparatus. The attachment mechanism preferably includes a repositioning track formed along the support and including a series of teeth, wherein the track includes a channel that is defined at least in part by a channel wall and a lip. The channel preferably includes at least one lateral disengagement space defined at least in part by the channel wall and the track teeth. The channel preferably includes a neck portion defined at least in part by the lip. The track teeth a preferably are formed along and extend upward from the lip. The repositionable attachment mechanism preferably further includes a slide coupling that is repositionable along the track, from which the toy can be suspended, and that includes at least one tooth that mates with the track teeth so that the track and coupling teeth interlock to hold the coupling in place but can be disengaged to reposition the coupling and the toy attached thereto. The coupling preferably includes a base with at least one lateral ledge extending from it. The coupling tooth is preferably formed on and extends downward from the lateral ledge, and a combined depth of the coupling lateral ledge and the coupling tooth that projects from it is less than a depth of the disengagement space. A combined weight of the coupling and the toy preferably causes the force of gravity to move the coupling tooth downward into interlocking engagement with the track teeth to retain the coupling in a locked position. The coupling can be moved upward to an unlocked position in which the track and coupling teeth are disengaged and the coupling lateral ledge is retracted into the disengagement space until the track and coupling teeth clear each other and are no longer interlocked. The disengaged coupling can be slid along the track and repositioned, and the coupling can be released so that the force of gravity moves the coupling back into the locked position.

In another aspect, the invention relates to an apparatus for supporting a child and attaching an object. The apparatus preferably includes a space where the child can be positioned, and at least one support extending adjacent the child-positioning space. The apparatus preferably also includes a repositionable attachment mechanism including a repositioning track formed along the support and a slide coupling that is repositionable along the track and to which the object can be attached adjacent the child-positioning space.

These and other aspects, features, and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are exemplary and explanatory of preferred embodiments of the invention, and are not restrictive of the invention, as claimed.

DETAILED DESCRIPTION OF EXAMPLE EMBODIMENTS

Figure 1:
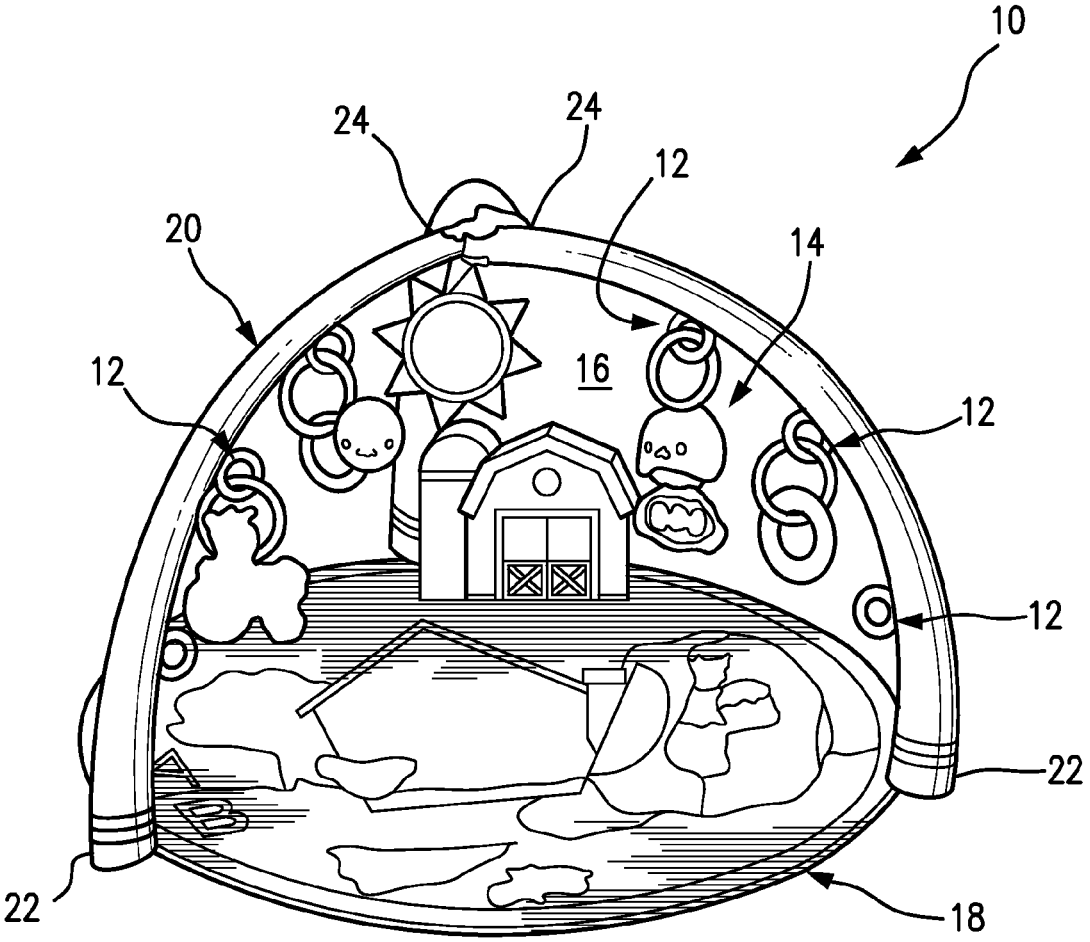
FIG. 1 is a front perspective view of a child-support apparatus including six repositionable toy-attachment mechanisms according to an example embodiment of the present invention.

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

The present invention relates to an apparatus for holding and/or amusing children. Such child-support apparatus include cribs, bassinets, car seats, strollers, swings, mobiles, bouncers, play gyms, play yards, jumpers, and other apparatus for supporting and/or amusing children. Thus, such child-support apparatus include children's toys with supports for suspending amusement portions of the toys, as well as other children's devices to which toys are attached in suspension, but that technically do not physically hold or support the child. The apparatus can be designed for a child of any age, including an infant, toddler, or older child. The apparatus includes one or more repositionable attachment mechanisms for suspending one or more toys for the amusement of the child in the apparatus. Such toys include models, mobiles, figurines, plush toys, rattles, bells, chimes, other noise-makers, and the like. In addition, such toys include teethers, pacifiers and other objects (for use by or on children) that are advantageously stored in a position near the child.

With reference now to the drawing figures, wherein like reference numbers represent corresponding parts throughout the several views, FIGS. 1-10 show a child-support apparatus 10, including six repositionable attachment mechanisms 12 for objects 14, according to an example embodiment of the present invention. In this embodiment, the child-support apparatus 10 is a play gym and the objects 14 are toys. In other embodiments, the toy-attachment mechanisms 12 are included in other types of child-support apparatus. And in yet other embodiments, more or fewer than six of the toy-attachment mechanisms 12 are included in the child-support apparatus.

Figure 2:
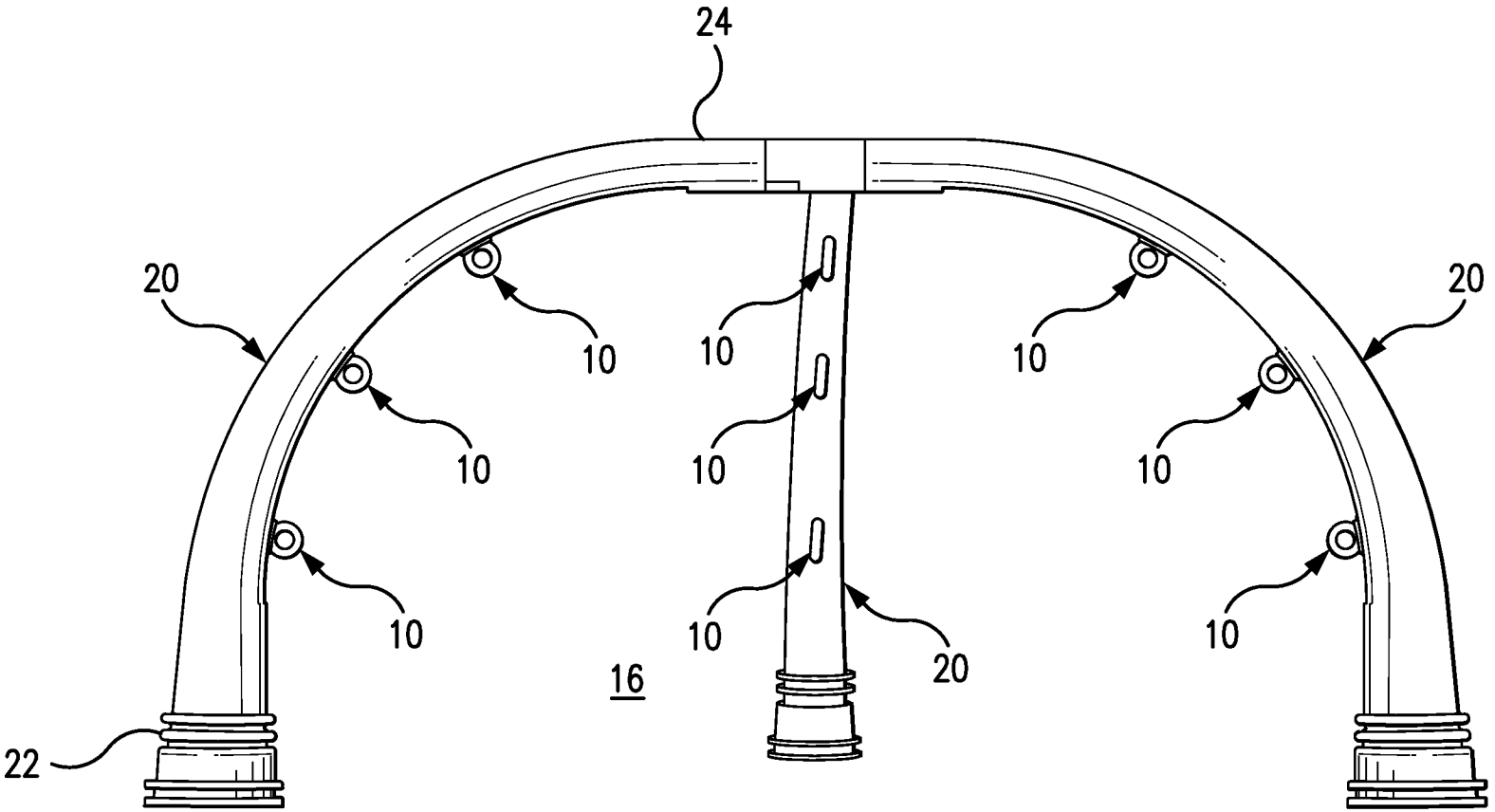
FIG. 2 is a front-side view of three support beams of the child-support apparatus of FIG. 1 showing the toy-attachment mechanisms positioned thereon.
Figure 3:
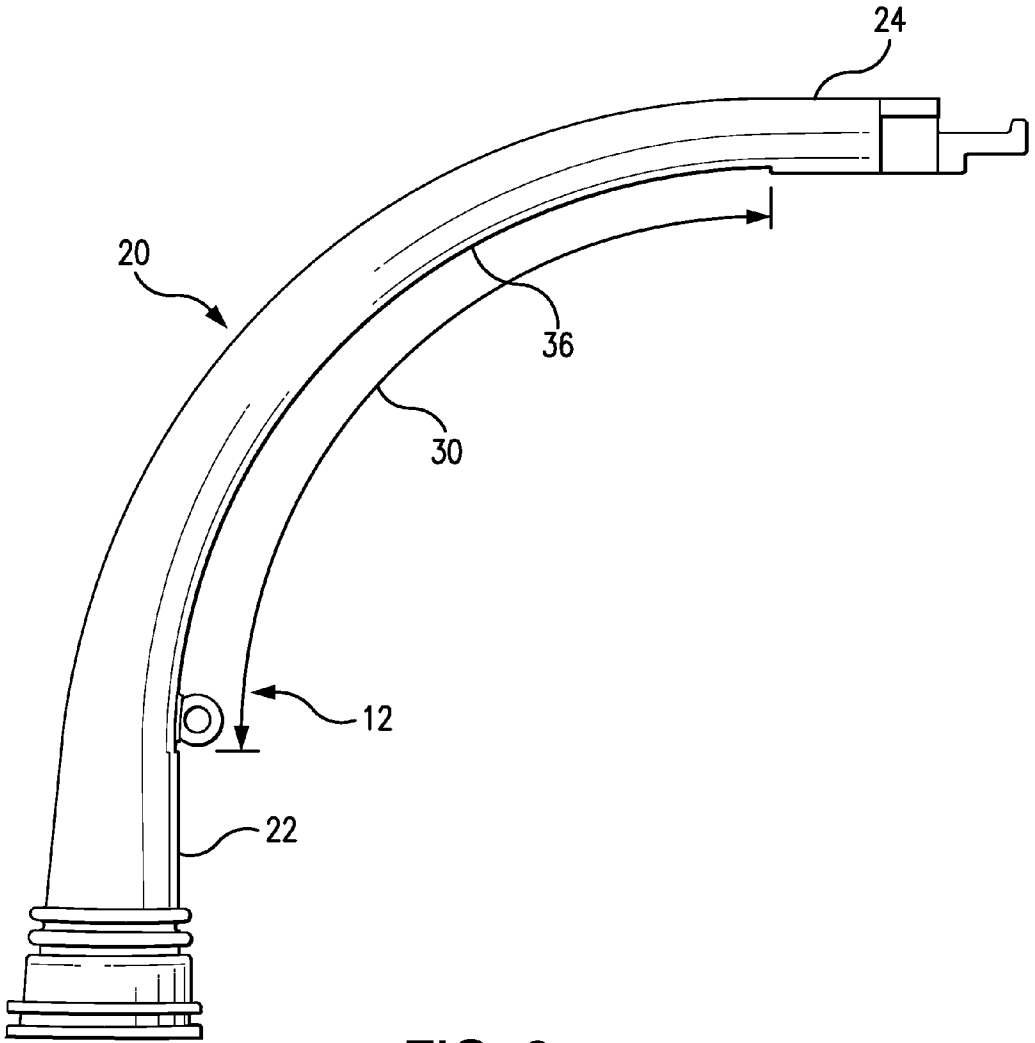
FIG. 3 is a front-side view of a left-positioned one of the support beams of the child-support apparatus of FIG. 2 showing one of the toy-attachment mechanisms positioned thereon.
Figure 4:
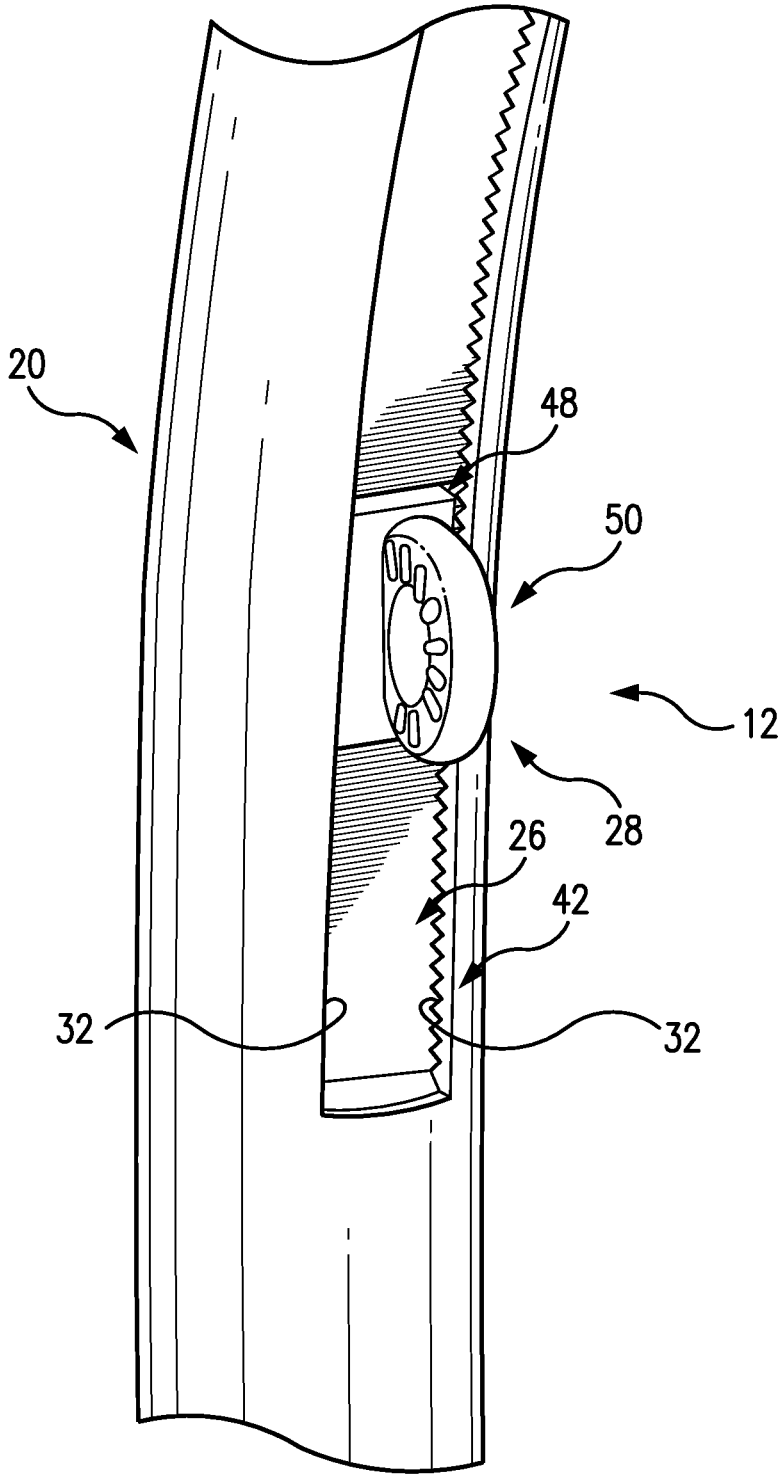
FIG. 4 is a right perspective view of a portion of the support beam of FIG. 3 showing a repositioning track and repositionable coupling of the toy-attachment mechanism.

Referring particularly to FIGS. 1-2, the child-support apparatus 10 defines a space 16 for the child to be positioned in, on or adjacent a base are 18, and includes one or more supports 20 extending upwards and laterally over the child space, with the toy-attachment mechanisms 12 positioned on the supports. In the depicted embodiment, for example, the apparatus 10 includes a child space 16 defined by a base panel or mat 18, and three support beams 20 that extend upward from the periphery of the apparatus and laterally over the mat 18. The beams 20 include lower portions 22 positioned at the apparatus 10. For example, they can be attached to or supported by the apparatus. And the beams 20 include upper portions 24 that extend over the child space 16 and for stability can be connected together generally centrally over the child space 16. The beams 20 can be made of a plastic or other conventional material and made using molding or other conventional techniques and equipment.

In other embodiments, more or fewer of the beams are provided and/or the beams are cantilevered (their upper portions are not connected together). Thus, in embodiments in which the apparatus is a car seat, the beam can be the carrier arm, in embodiments in which the apparatus is a stroller, the beam can be the canopy-support arm, and in embodiments in which the apparatus is a toy, the beam can be a bar or arm supporting the entertainment portion of the toy. In addition, in some embodiments, the beam or other support does not actually extend from another portion of the child-support apparatus 10, but rather, it is an integral component of the apparatus such as a rigid roof of a playhouse.

Referring particularly to FIGS. 3-10, the toy-attachment mechanism 12 includes at least one repositioning track 26 and at least one repositionable coupling 28 in sliding engagement with the track. In the depicted embodiment, a single repositioning track 26 is provided for three repositionable couplings 28. The track 26 has a span 30 and each of the couplings 28 can be repositioned to anywhere along all or at least a portion of the span of the track (except, of course, two couplings cannot be located in the same physical space or slid past each other). In this way, a user can slide the couplings 28 along the track 26 to vary the location and/or height (relative to the underlying child space 16) of the respective toys 14 that are coupled thereto. In other embodiments, a single track is provided for more or fewer than three couplings. And in yet other embodiments, each coupling slides along its own dedicated track, and more than one track may optionally be provided on a support. In some embodiments, a release mechanism is provided that can be actuated to remove the repositionable couplings have from the track so that more or fewer couplings can be used and so that the couplings can be arranged differently, as may be desired.

In the depicted embodiment, the repositioning track 26 includes a series or rack of teeth 32 and the repositionable couplings 28 each include at least one tooth 34 (typically, they include a series of teeth). The coupling teeth 34 mate with the track teeth 32 in an interlocking manner to retain the coupling 28 in a selected engaged or locked position on the track 26. In the depicted embodiment, the track teeth 32 and coupling teeth 34 are provided by serial triangular-shaped projections defining triangular-shaped recesses between adjacent projections, with the opposing projections and recesses receiving each other in the interlocking manner (see FIG. 5). In other embodiments, the teeth are square, wedge-shaped, arcuate, non-symmetrical, and/or provided in another regular or irregular pattern and shape, so long as they provide the coupling-repositioning functionality and allow the force of gravity or other biasing force to retain the teeth in locking engagement. In still further embodiments, one or more clamps, clips, releasable couplings, spring-biased, magnetic or other positional fixing means may be utilized in place of teeth for repositionably fixing the coupling in a selected position along the track. For example, for a portion of the track on a nearly vertical portion of the support beam, the teeth can be wedge-shaped with a nearly horizontal top surface to help retain the teeth in locking engagement (as described below). In yet other embodiments, the coupling teeth are provided by only one projection or recess that slidingly engages the respective recesses or projections of the track. And in still other embodiments, a lock mechanism (e.g., a clamp or spring-biased retainer) is provided to further secure the couplings in the locked position.

The repositioning track 26 typically extends along an inner/lower surface 36 (from which the toys 14 can be suspended without obstruction) of the support beam 20 and includes a channel 38 defined at least in part by a channel wall 40 and two lips 42. In the depicted embodiment, for example, the channel 38 is T-shaped with two lateral disengagement spaces 44 and a narrower neck portion 43 between them (the space between the lips 42). The track teeth 32 extend upward/outward from the lips 42, which extend along the inner/lower surface 36 of the support beam 20. The disengagement spaces 44 are formed between the track teeth 32 and the channel wall 40. And when the repositionable couplings 28 are engaged with the track 26, the coupling teeth 34 face downward/inward. The coupling teeth 34 extend downward/inward from at least one lateral ledge 46 of a base 48 of the coupling 28. In the depicted embodiment, for example, the coupling base 34 is T-shaped with two lateral ledges 46 extending from it in opposite directions. The disengagement space 44 of the track 26 has a depth that is greater than the combined depth of the coupling lateral ledge 46 and the coupling teeth 34 that project from it to permit the disengagement of the track and coupling teeth 32 and 34 to reposition the coupling 28. To prevent the coupling 28 from retracting all the way into the track channel 38 and jamming, and to help retain the track and coupling teeth 32 and 34 in the interlocked position but also smoothly slide the coupling in the unlocked position, the channel wall 40 is typically positioned so that the depth of the disengagement space 44 is only slightly greater than the combined depth of the coupling lateral ledge 46 and the coupling teeth. In other embodiments, the channel wall is not so positioned and the couplings are held by and/or guided along the track by wings, tabs, or other keyed guide/retention elements.

Figure 5:
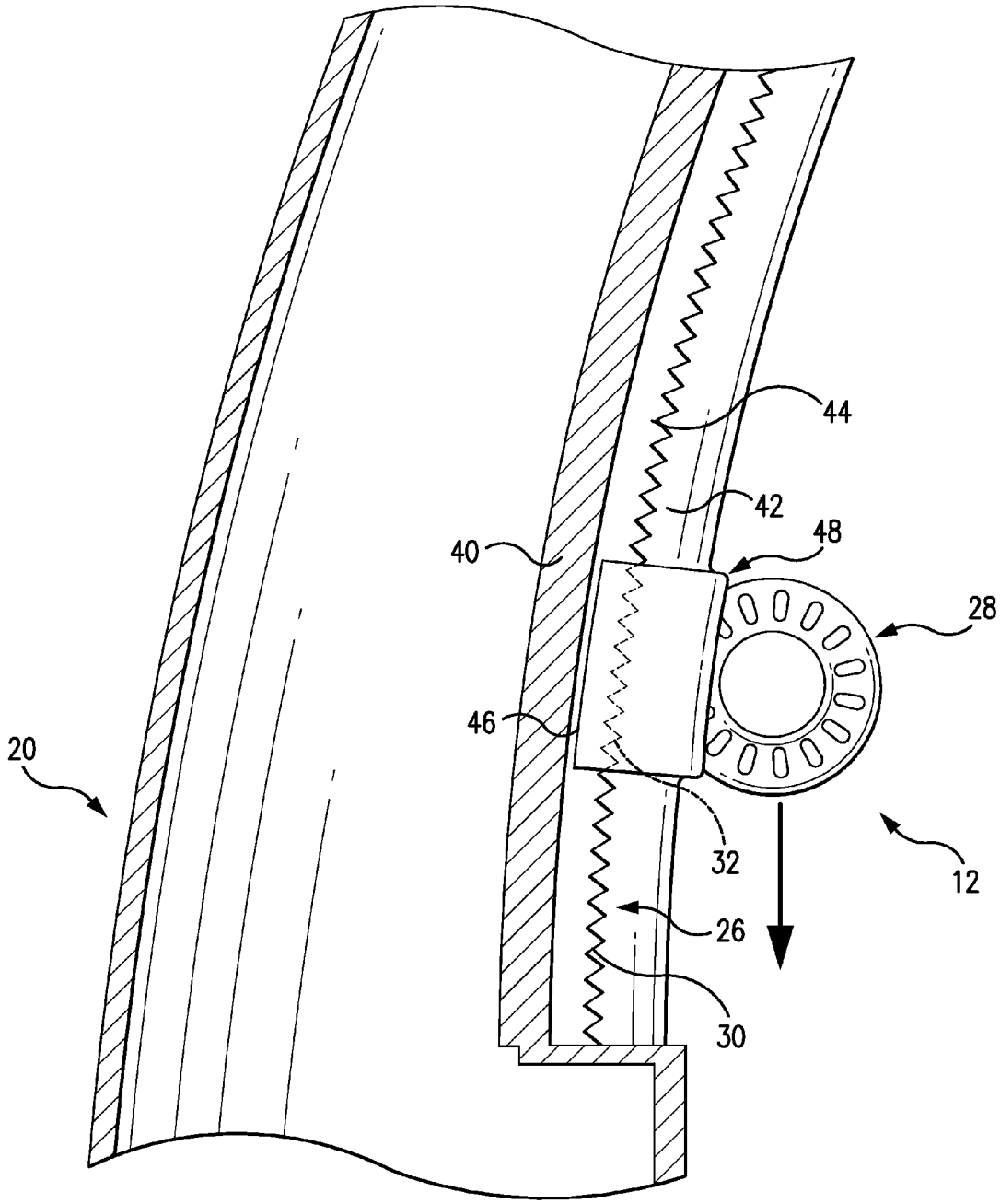
FIG. 5 is a longitudinal cross-section view of the support beam portion of FIG. 4 showing the coupling in a first engaged/locked position on the track.
Figure 7:
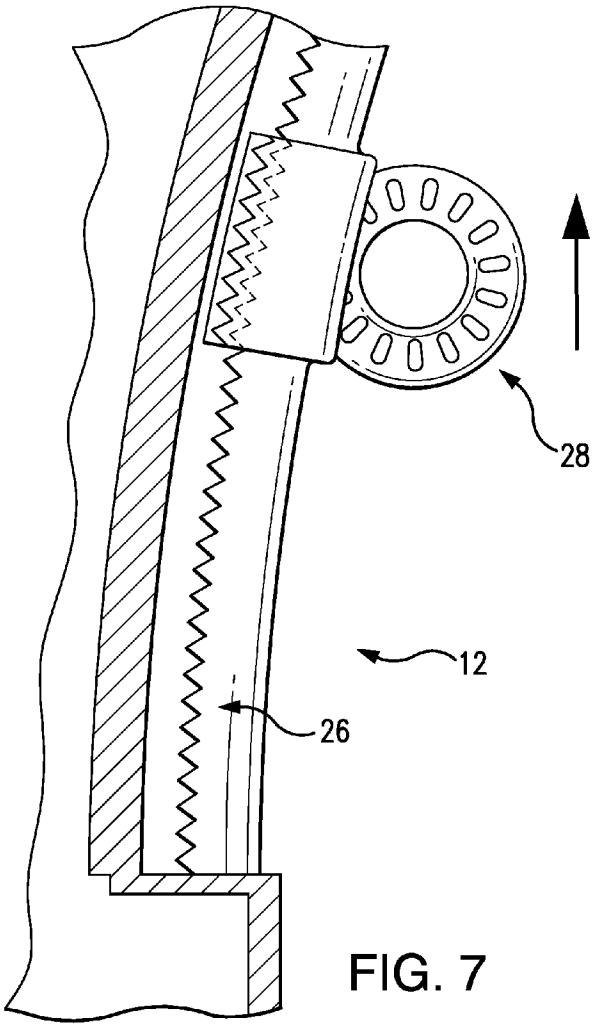
FIG. 7 shows the support beam portion of FIG. 5 with the disengaged/unlocked coupling being slid to a new position on the track.
Figure 6:
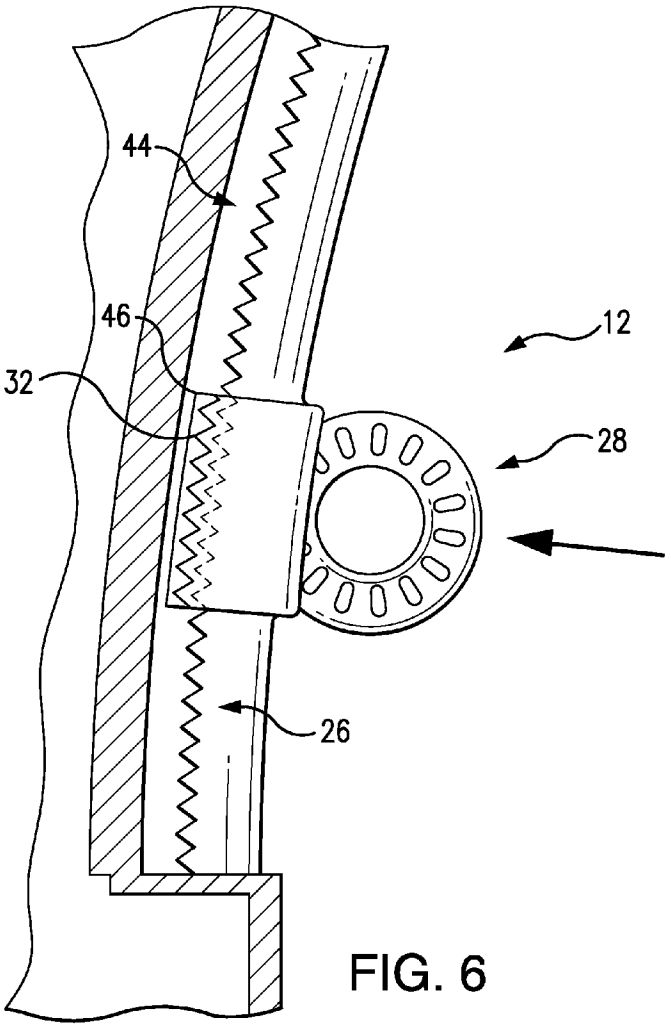
FIG. 6 shows the support beam portion of FIG. 5 with the coupling moved to a disengaged/unlocked position.
Figure 8:
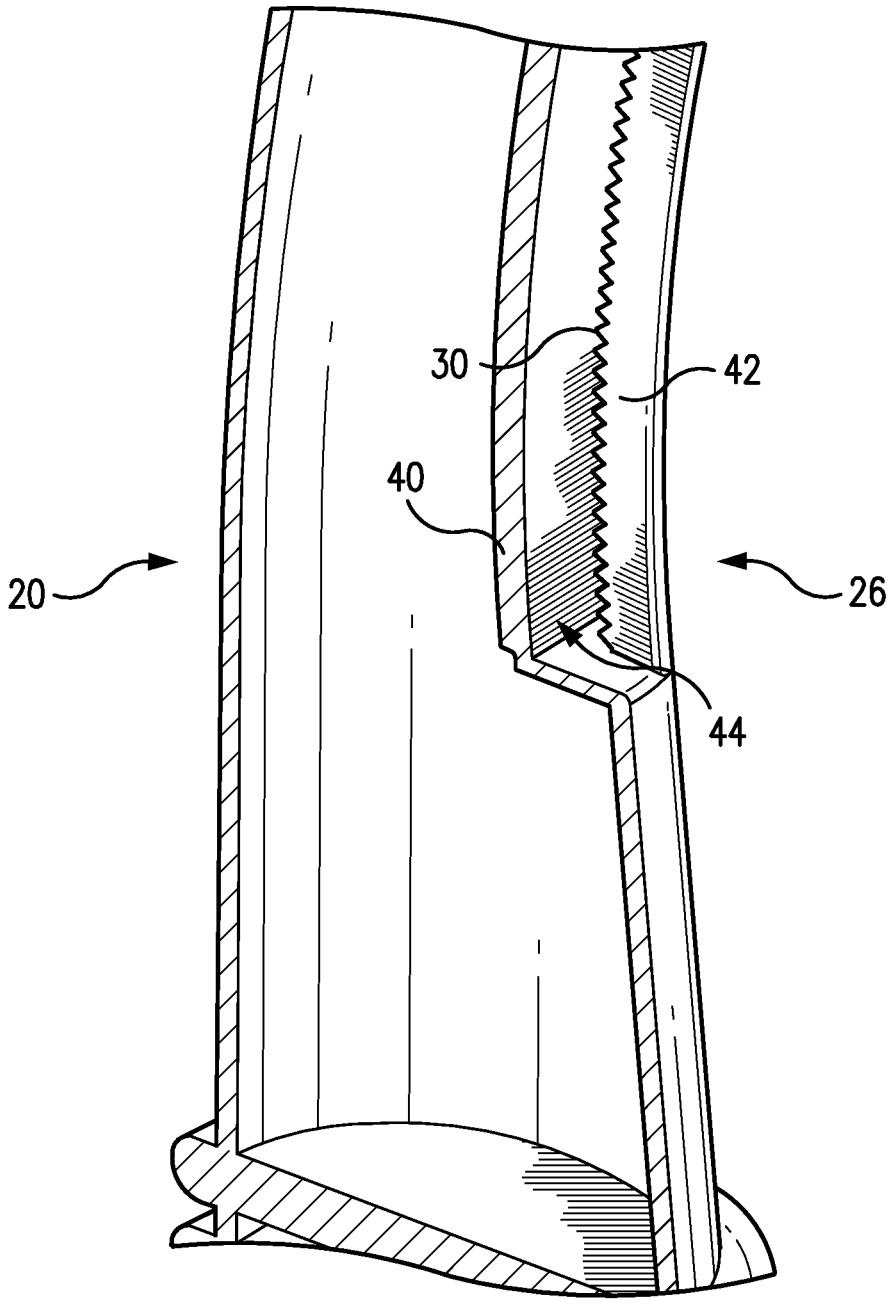
FIG. 8 is a right perspective view of a portion of the support beam of FIG. 4.
Figure 9:
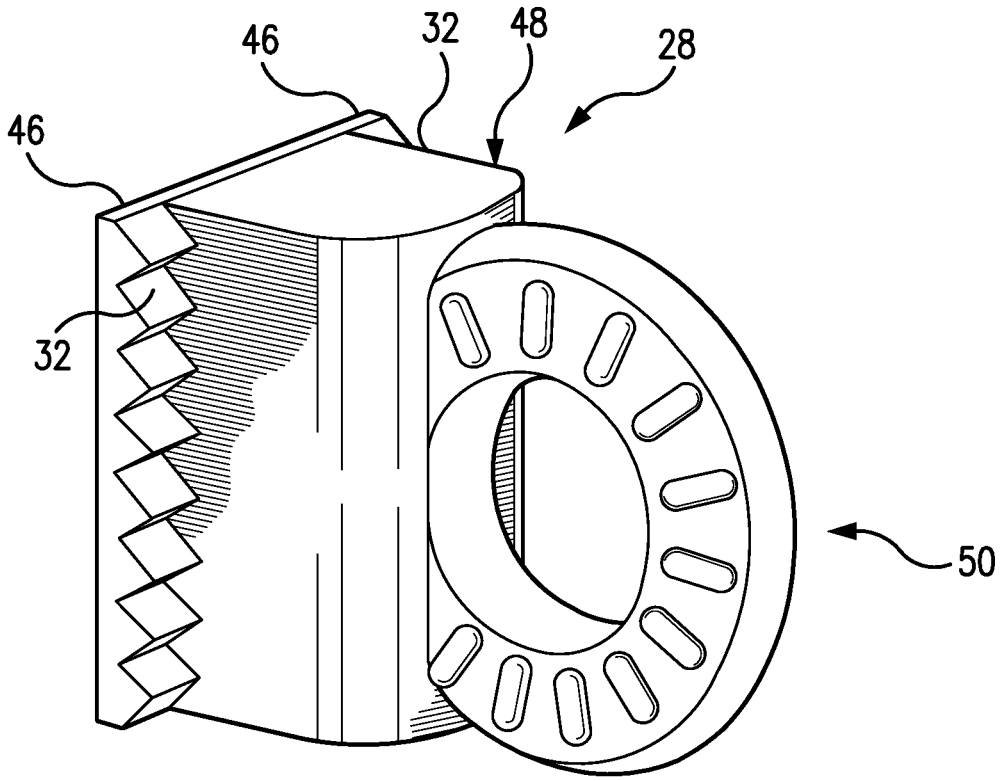
FIG. 9 is a right perspective view of a repositionable coupling of the toy-attachment mechanism of FIG. 4.
Figure 10:
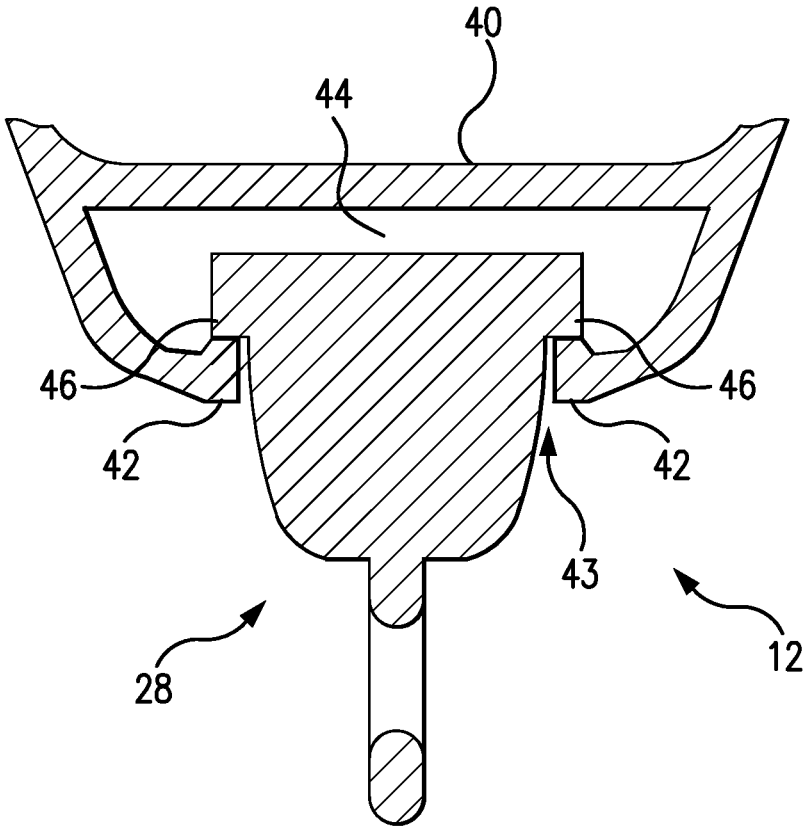
FIG. 10 is an axial cross-section view of the toy-attachment mechanism of FIG. 4.

In this way, as shown in FIG. 5, when a toy 14 is hung from the coupling 28, their combined weight pulls the coupling teeth 34 downward into interlocking engagement with the track teeth 32 under the force of gravity (indicated by the directional arrow). As such, the portion of the support beam 20 along the span 30 of the track has a lateral aspect to it so that the effect of gravity can be realized to interlock the track teeth 32 and coupling teeth 34 together and thereby retain the couplings 28 in fixed/locked positions along the span 30 of the track 26. As shown in FIG. 6, the couplings 28 can be moved inward/upward (indicated by the directional arrow) so that the coupling lateral ledge 46 is retracted into the disengagement space 44 until the track and coupling teeth 32 and 34 clear each other and are no longer interlocked. And as shown in FIG. 7, when in this disengaged/unlocked state the coupling 28 can be slid (as indicated by the directional arrow) along the track 26 to reposition it at a new location along the track 26, and then released so that the force of gravity will move the coupling 28 back into the locked/engaged position with the track and coupling teeth 32 and 34 interlocked in the manner depicted in FIG. 5. In alternate embodiments, spring-biased, magnetic or other biasing means bias the coupling toward the locked/engaged position, and the attachment mechanism can be positioned in any orientation without regard to gravity.

In the depicted embodiment, the repositioning track 26 includes two lips 42 defining two series of track teeth 32. And the repositionable coupling 28 is slidingly engaged by the track 26 and includes two lateral ledges 46 extending in opposite directions and defining two series of coupling teeth 34. This provides a good amount of tooth-engaging surface area and thus a good locking effect under a relatively small gravitational force for use with light-weight toys 14. And this provides an arrangement in which the coupling 28 is captive in the track 26 (the lateral ledges 46 of the T-shaped base 48 are wider than the narrowed neck portion 43 of the T-shaped channel 38) so that the coupling 28 cannot be dislodged or otherwise removed and become a choking hazard (see FIG. 10). In other embodiments, the repositioning track includes only one lip (e.g., the track channel and coupling base are each generally L-shaped) or more than two lips, each defining a series of track teeth, and the coupling includes only one or more than two lateral ledges, each defining one or a series of coupling teeth.

In addition, the coupling 28 includes a connector 50 for attaching and hanging the toys 14 or other objects. In the depicted embodiment, the connector 50 is in the form of a loop for attaching one or more toys 14. In other embodiments, the connector is in the form of a hook, finger, eyelet, strap, snap, or other conventional fastener that can be used to attach one or more toys 14 in suspension.

Figure 11:
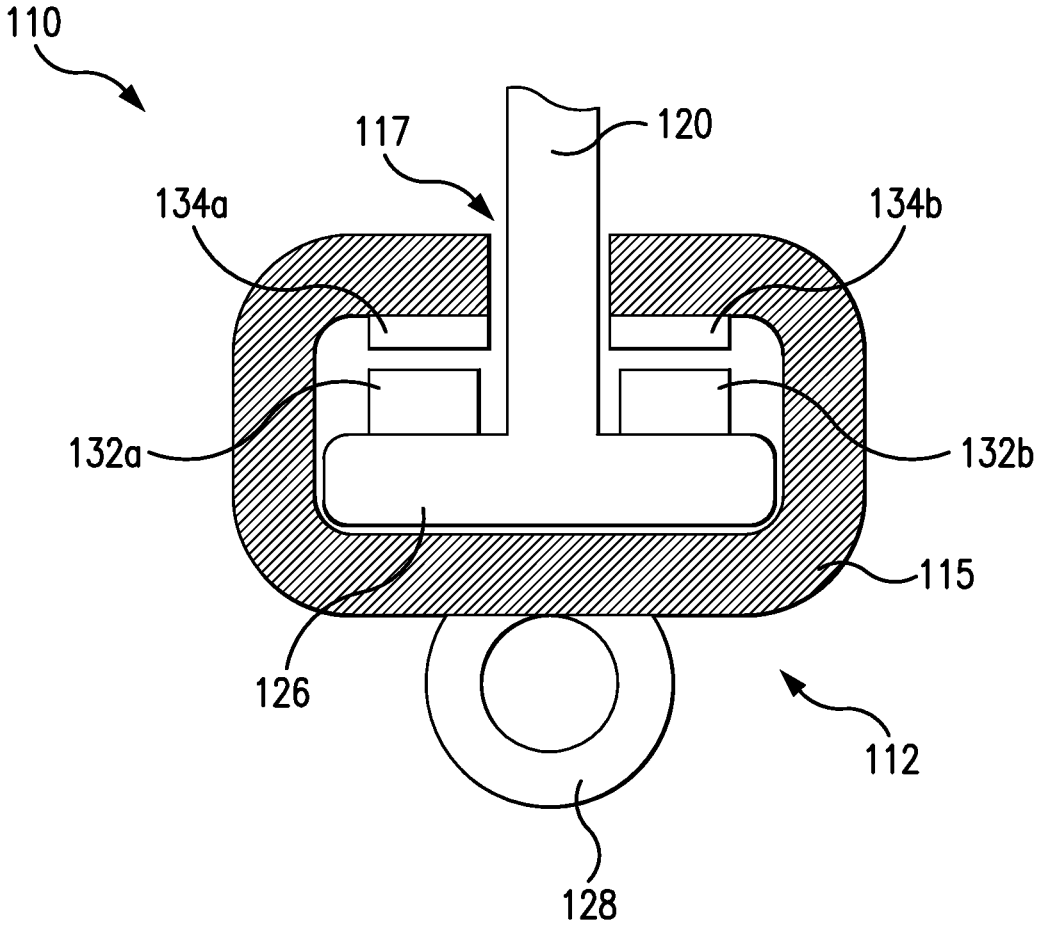
FIG. 11 is a cross-sectional view of a toy-attachment mechanism according to another example form of the invention.

FIG. 11 shows an alternate embodiment of a toy attachment mechanism 110 according to an example form of the invention. The toy attachment mechanism 110 includes a coupling 112 comprising a generally C-shaped channel 115 having a slot 117 extending through a side thereof. A generally T-shaped repositioning track 120 extends along or from at least a portion of the support apparatus and through the slot 117 of the coupling 112, and includes a rail 126 having track teeth 132*a*, 132*b* extending along upper side faces thereof. The rail 126 has a width greater than that of the slot 117, thereby retaining the coupling 112 on the track 120. The track teeth 132*a*, 132*b* repositionably engage with coupling teeth 134*a*, 134*b* of the coupling. The channel 115 of the coupling 112 has a sufficient depth to allow the coupling teeth 134*a*, 134*b* to be disengaged from the track teeth 132*a*, 132*b* by lifting the coupling, thereby allowing repositioning of the coupling along the track 120. Releasing the coupling 112 re-engages the coupling teeth 134*a*, 134*b* with the track teeth 132*a*, 132*b* to fix the coupling in a selected position along the track 120. A connector 128 extends from the coupling for attachment of a toy or other item.

In other embodiments, the repositionable attachment mechanism includes a zipper assembly, for example one with two sliders that slide together so that an opening is not formed as they slide along the zipper chain. In yet other embodiments, the repositionable attachment mechanism includes a friction-fit slide, ratchet mechanism, snap-fit coupling, gears, notches, clips, clamps, snaps, and/or other components for selectively repositioning the toys or other objects on the child-support apparatus.

In another aspect, the invention includes the repositionable toy-attachment mechanism 12, but not the child-support apparatus 10. In yet another aspect, the invention includes the repositionable toy-attachment mechanism 12 and the support 20, but not the rest of the child-support apparatus 10. And in yet another aspect, the invention includes the repositionable toy-attachment mechanism 12 and the child-support apparatus 10 with the toys 14 or other objects permanently (for the design life of the apparatus) attached to the attachment mechanism 12 in a stationary position.

While the invention has been described with reference to example embodiments, it will be understood by those skilled in the art that a variety of modifications, additions, and deletions are within the scope of the invention, as defined by the following claims.

What is claimed is:

1. An attachment mechanism for repositionably attaching an object to a child-support apparatus, the attachment mechanism comprising:

a repositioning track formed along the child-support apparatus; and a slide coupling that is repositionable along the track and to which the object can be attached, wherein the track includes a series of teeth and the coupling includes at least one tooth that mates with the track teeth so that the track and coupling teeth interlock to hold the coupling in place but can be disengaged to reposition the coupling and the objects attached thereto, wherein the track teeth extend substantially upward and, when the repositionable coupling is engaged with the track, the coupling tooth extends substantially downward, and wherein due to a combined weight of the coupling and the object the force of gravity moves the coupling tooth downward into interlocking engagement with the track teeth to retain the coupling in a locked position, the coupling can be moved upward to an unlocked position in which the track and coupling teeth are disengaged, the disengaged coupling can be slid along the track and repositioned, and the coupling can be released so that the force of gravity moves the coupling back into the locked position.

2. The repositionable attachment mechanism of claim 1, wherein the track is formed along a surface of the support having a lateral aspect so that the effect of gravity can be realized to interlock the track and coupling teeth together and retain the coupling in the locked position.

3. The repositionable attachment mechanism of claim 1, wherein the coupling comprises a channel and the track is T-shaped and extends through the channel.

4. The repositionable attachment mechanism of claim 1, wherein the child-support apparatus is a crib, bassinet, car seat, stroller, swing, mobile, bouncer, play gym, play yard, high chair, lounger, motion device, entertainer, walker, or jumper.

5. The repositionable attachment mechanism of claim 1, wherein the child-support apparatus includes a support beam where the repositioning track is formed.

6. An attachment mechanism for repositionably attaching an object to a child-support apparatus, the attachment mechanism comprising:

a repositioning track formed along the child-support apparatus; and a slide coupling that is repositionable along the track and to which the object can be attached, wherein the track includes a series of teeth and the coupling includes at least one tooth that mates with the track teeth so that the track and coupling teeth interlock to hold the coupling in place but can be disengaged to reposition the coupling and the objects attached thereto, and wherein the coupling includes a base with at least one lateral ledge extending from it, the coupling tooth formed on the lateral ledge, wherein the track includes a channel that is defined at least in part by a channel wall and a lip, the channel including at least one lateral disengagement space defined at least in part by the channel wall and the track teeth, the channel including a neck portion defined at least in part by the lip, the track teeth formed along the lip, and the disengagement space having a depth that is greater than a combined depth of the coupling lateral ledge and the coupling tooth that projects from it, and wherein the coupling is moved from the locked position to the unlocked position by moving the coupling upward so that the coupling lateral ledge is retracted into the track disengagement space until the track and coupling teeth clear each other and are no longer interlocked.

7. The repositionable attachment mechanism of claim 6, wherein the coupling base is T-shaped and includes two of the lateral ledges extending from it in opposite directions, and wherein the track channel is T-shaped and includes two of the lateral disengagement spaces for receiving the two lateral ledges of the coupling base in a captive arrangement.

8. The repositionable attachment mechanism of claim 6, wherein the coupling comprises a channel and the track is T-shaped and extends through the channel.

9. The repositionable attachment mechanism of claim 6, wherein the child-support apparatus is a crib, bassinet, car seat, stroller, swing, mobile, bouncer, play gym, play yard, high chair, lounger, motion device, entertainer, walker, or jumper.

10. The repositionable attachment mechanism of claim 6, wherein the child-support apparatus includes a support beam where the repositioning track is formed.

11. A repositionable attachment mechanism for suspending a toy from a support of a child-support apparatus, the attachment mechanism comprising:

a repositioning track formed along the support and including a series of teeth, wherein the track includes a channel that is defined at least in part by a channel wall and a lip, the channel including at least one lateral disengagement space defined at least in part by the channel wall and the track teeth, the channel including a neck portion defined at least in part by the lip, the track teeth formed along and extending upward from the lip; and a slide coupling that is repositionable along the track, from which the toy can be suspended, and that includes at least one tooth that mates with the track teeth so that the track and coupling teeth interlock to hold the coupling in place but can be disengaged to reposition the coupling and the toy attached thereto, wherein the coupling includes a base with at least one lateral ledge extending from it, the coupling tooth is formed on and extends downward from the lateral ledge, and a combined depth of the coupling lateral ledge and the coupling tooth that projects from it is less than a depth of the disengagement space, wherein a combined weight of the coupling and the toy causes the force of gravity to move the coupling tooth downward into interlocking engagement with the track teeth to retain the coupling in a locked position, the coupling can be moved upward to an unlocked position in which the track and coupling teeth are disengaged and the coupling lateral ledge is retracted into the disengagement space until the track and coupling teeth clear each other and are no longer interlocked, the disengaged coupling can be slid along the track and repositioned, and the coupling can be released so that the force of gravity moves the coupling back into the locked position.

12. The repositionable attachment mechanism of claim 11, wherein the track is formed along a surface of the support having a lateral aspect so that the effect of gravity can be realized to interlock the track and coupling teeth together and retain the coupling in the locked position.

13. The repositionable attachment mechanism of claim 11, wherein the coupling base is T-shaped and includes two of the lateral ledges extending from it in opposite directions, wherein the track channel is T-shaped and includes two of the lateral disengagement spaces for receiving the two lateral ledges of the T-shaped coupling base in a captive arrangement.

14. The repositionable attachment mechanism of claim 11, wherein the track has a span and the coupling can be positioned anywhere along the span.

15. The repositionable attachment mechanism of claim 11, wherein the track receives a plurality of the couplings that each can be repositioned along the track.

16. The repositionable attachment mechanism of claim 11, wherein the coupling includes a connector adapted to attach and suspend therefrom at least one of the objects.

17. The repositionable attachment mechanism of claim 11, wherein the child-support apparatus is a crib, bassinet, car seat, stroller, swing, mobile, bouncer, play gym, play yard, high chair, lounger, motion device, entertainer, walker, or jumper.

18. The repositionable attachment mechanism of claim 11, wherein the support is a beam.

* * * * *